US005856287A

United States Patent [19]

Motyka et al.

[11] Patent Number: 5,856,287

[45] Date of Patent: Jan. 5, 1999

[54] LAUNDRY CONCENTRATES

[75] Inventors: Andrea Lee Motyka, Doylestown, Pa.; Guy Broaze, Grace-Hollogne, Belgium; Alison Kugler, South River, N.J.

[73] Assignee: Colgate-Palmolive Co., New York, N.Y.

[21] Appl. No.: 679,747

[22] Filed: Jul. 15, 1996

Related U.S. Application Data

[63] Continuation of Ser. No. 396,858, Mar. 1, 1995, abandoned.

[51] Int. Cl.[6] ..... C11D 10/02

[52] U.S. Cl. ..... 510/342; 510/338; 510/328

[58] Field of Search ..... 252/8.8, 8.6, 8.9, 252/174.21, 547, 170, 8.63; 510/342

[56] References Cited

U.S. PATENT DOCUMENTS

| | | | |
|---|---|---|---|
| 4,426,299 | 1/1984 | Verbuggen | 252/8.8 |
| 4,429,859 | 2/1984 | Steiner et al. | 252/8.8 |
| 4,715,969 | 12/1987 | Rothanavibhata et al. | 252/8.7 |
| 4,767,547 | 8/1988 | Straathof et al. | 252/8.8 |
| 4,769,159 | 9/1988 | Copeland | 252/8.8 |
| 5,066,414 | 11/1991 | Chang | 252/8.8 |
| 5,151,223 | 9/1992 | Maaser | 252/547 |
| 5,221,794 | 6/1993 | Ackerman et al. | 548/349.1 |
| 5,288,423 | 2/1994 | Behan et al. | 252/174.11 |
| 5,288,847 | 2/1994 | Harmalker et al. | 252/8.8 |
| 5,368,756 | 11/1994 | Vogel et al. | 252/8.8 |
| 5,403,500 | 4/1995 | Turner | 252/8.8 |
| 5,409,621 | 4/1995 | Ellis et al. | 252/8.8 |
| 5,468,398 | 11/1995 | Farooq et al. | 252/8.8 |
| 5,474,690 | 12/1995 | Wahl et al. | 252/8.8 |
| 5,501,806 | 3/1996 | Farooq et al. | 252/8.8 |

FOREIGN PATENT DOCUMENTS

| | | |
|---|---|---|
| 280550 | 8/1988 | European Pat. Off. . |
| 243953 | 12/1988 | European Pat. Off. . |
| 0301883 | 2/1989 | European Pat. Off. . |
| 409504 | 1/1991 | European Pat. Off. . |
| 0503221 | 9/1992 | European Pat. Off. . |
| 2007734 | 5/1979 | United Kingdom . |
| 9502664 | 1/1995 | WIPO . |

*Primary Examiner*—John M. Ford
*Assistant Examiner*—Pavanaram K Sripada
*Attorney, Agent, or Firm*—Bernard Lieberman

[57] ABSTRACT

The present invention provides laundry concentrate compositions comprising a mixture of at least one non-ionic surfactant and at least one water insoluble, polar group—containing oil, wherein the concentrate is characterized by a viscosity in excess of about 10 cps, preferably in excess of 100 cps, and further characterized that, upon dilution with at least about one volume of water per volume of concentrate, the concentrate is converted at least partially into a liquid crystal phase dispersion, providing a diluted concentrate having a viscosity of at least about 50 cps.

Preferred concentrates are fabric softeners in the form of a water-in-oil emulsion and also containing a cationic or non-ionic fabric softener.

12 Claims, No Drawings

LAUNDRY CONCENTRATES

This is a continuation of application Ser. No. 08/396,858 filed Mar. 1, 1995, now abandoned.

BACKGROUND OF THE INVENTION

1. Field of the Invention

This invention relates to laundry concentrates adapted to be diluted with water by the consumer prior to use.

2. Description of Related Art

There is a trend in the household products and personal care industries to provide products in concentrated form which are adapted to be diluted with water by the consumer prior to use. This approach reduces the bulk of packaging which needs to be disposed of by the consumer and reduces the shipping and handling costs associated with distribution of such products.

Laundry concentrates such as fabric softeners, fabric and dishwasher detergents may be provided with a high content of active ingredients such that, when diluted by the consumer per packaging instructions, the diluted product will contain an amount of active ingredients normally present in a non-concentrated product.

However, the provision of concentrated liquids gives rise to a number of problems, including viscosity control and stability.

Concentrated liquids tend to exhibit a higher viscosity due to the high content of surfactants, builders, electrolytes, fabric softeners and/or other components present in the concentrate. Concentrates having viscosities in excess of 1500 cps (mpas) tend to be difficult to pour from the packaging container, while pourable, lower viscosity concentrates tend to have insufficient viscosity when appropriately diluted by the consumer thereby reducing consumer appeal.

One approach to dealing with poor post dilution viscosity is to include in the liquid concentrate formulation one or more organic or inorganic thickening agents such as swelling clays, alumina, gums, polymeric materials or cellulosic polymers. However, the use of such thickening additives tends to worsen the problem of concentrate pourability and imparts only a minimal viscosity increase to the diluted concentrate.

Hydrophilic polymeric materials have also been used in liquid detergent concentrates as viscosity control agents. For example, U.S. Pat. No. 4,715,969 discloses that the addition of less than about 0.5% by weight of a polyacrylate polymer, e.g., sodium polyacrylate, having a molecular weight from about 1,000 to 5,000, to aqueous detergent compositions containing primarily anionic surfactants will stabilize the viscosity of the composition and prevent a major increase in viscosity after a period of storage of the formulated composition. Also, EP 301,883 discloses similar compositions containing from about 0.1 to 20% by weight of a viscosity reducing, water soluble polymer such as polyethylene glycol, dextran or a dextran sulfonate.

Concentrated fabric softener compositions are also known in the prior art. For example, GB 2007734 discloses a fabric softener concentrate comprising a mixture of non-ionic ethoxy fatty alcohol surfactant, a water insoluble oil and a quaternary ammonium salt such as dimethyl distearyl ammonium chloride. The concentrate is adapted to be dispersed into water to provide a diluted fabric softener dispersion. In addition, EPA 0503221 A1 discloses concentrated fabric softener compositions which are said to retain viscosity after dilution with water. The concentrate comprises an aqueous dispersion of a mixture of a fatty alcohol ethoxylate, a nonionic hydrophilic polymer, a cationic fabric softener, a highly branched fatty alcohol of 8 to 18 carbon atoms and a linear or cyclic polydialkylsiloxane.

While these and other approaches tend to enhance concentrate pourability, they do not solve the problem of low post-dilution viscosity or stability of the diluted concentrate.

Accordingly, it is an object of the invention to provide a liquid laundry concentrate which exhibits a sufficiently low viscosity such that it is readily pourable from its packaging container and which also exhibits a viscosity after appropriate dilution with water which is at least 50 cps, thereby contributing to consumer appeal.

SUMMARY OF THE INVENTION

The present invention provides laundry concentrate compositions comprising a mixture of at least one non-ionic surfactant and at least one water insoluble fatty oil containing a hydrophilic polar group and having a melting point below 30° C., wherein the concentrate is characterized by a viscosity in excess of about 10 cps, often in excess of 100 cps, and further characterized that, upon dilution with at least about one volume of water per volume of concentrate, the concentrate is converted at least partially into a liquid crystal phase dispersion, providing a diluted concentrate having a viscosity of at least about 50 cps.

The invention also provides a method for preparing a diluted laundry concentrate comprising:

a) providing a laundry concentrate comprising a mixture of at least one non-ionic surfactant and at least one water insoluble oil, and, optionally, water, said concentrate having a viscosity of from about 10 to 1,500 cps; and b) diluting the concentrate with at least one volume of water per volume of concentrate such that said concentrate is at least partially converted into a liquid crystal phase dispersion, providing a diluted concentrate having a viscosity of at least about 50 cps.

Preferred concentrates are fabric softeners in the form of a water-in-oil emulsion and also containing a cationic or non-ionic fabric softener.

DETAILED DESCRIPTION OF THE INVENTION

Where certain surfactants are mixed with water and a non-water soluble oil to form an emulsion, the emulsion may exist as three major phases depending on the amount of water and the amount and type of oil and surfactant present. These major phases are the "$L_2$" phase which represents a water-in-oil (or inverse micellar) emulsion phase, the "$L_1$" phase which is the oil-in-water (or micellar) phase where the emulsion contains a major proportion of water, and the so called $L_c$ (liquid crystal phase) roughly in between conversion of the water-in-oil emulsion to an oil-in-water emulsion as water content of the system is increased. Some $L_c$ phase development can be achieved even in very dilute emulsions. $L_c$ phase emulsions are generally characterized as viscoelastic phases having emulsion viscosities which are either higher than the viscosities of the adjacent $L_2$ and $L_1$ emulsion phases or at least higher than would be expected based on a linear interpolation of $L_2$ and $L_1$ emulsion phase viscosities at low and high water content.

The present invention is grounded on the discovery that aqueous emulsions can be first formulated in the so called $L_c$ phase by proper selection of oil, surfactant and quantity of water to provide emulsions having readily pourable viscosities in the range of from about 50 to about 1000 cps, and then concentrated by reducing water content by a specified amount to provide $L_2$ emulsion concentrates having pourable viscosities in the range of from about 10 to about 1500 cps. Dilution of these concentrates by the consumer by mixing in the specified amount of water will result in the redevelopment of emulsions, at least partially in the $L_c$ phase, having viscosities either in excess of or equal to the viscosity of the concentrate, or viscosities at least higher than would be expected based on a linear interpolation of $L_2$ and $L_1$ emulsion viscosities as a function of increased dilution, thereby enhancing consumer appeal. Dilution levels of the concentrate may generally range from about 1 to about 4 volumes of water per volume of concentrate.

The oil component of the concentrate may comprise one or a mixture of water insoluble organic compounds containing a polar proton sharing group such as hydroxy, carboxylic, amine or amido, which have a melting point below about 30° C. Preferred oils are saturated aliphatic alcohols or monocarboxylic acids containing from about 6 to 12 carbon atoms which are liquids or waxy liquids at or below 25° C. C, e.g. hexanol, octanol or dodecanol and the corresponding monocarboxylic acids such as caproic, caprylic, pelargonic and undecanoic acids as well as amides thereof. Also suitable are unsaturated liquid fatty $C_{16}$ to $C_{18}$ acids and alcohols such as oleic, linoleic, ricinoleic and linolenic acids and the corresponding alcohols. Branched Guerbet alcohols such as are available from Exxon Chemical Co. may also be used.

The amount of oil present in the concentrate may generally be up to about 60% by weight in concentrates having a high level of active ingredients and little or no added water. Preferred concentrates containing fabric softener in the form of water-in-oil emulsions will generally contain from about 1 to about 55% by weight, more preferably 3 to 25% by weight of the oil component.

The surfactants which may be used in the present invention may be selected from non-ionic, anionic and amphoteric species, including mixtures containing different species or mixtures of different surfactants within the same species.

Nonionic surfactants which can be used to form the emulsions include compounds produced by the condensation of alkylene oxide groups (hydrophilic in nature) with an organic hydrophobic compound, which may be aliphatic or alkyl aromatic in nature. Examples of preferred classes of nonionic surfactants are:

a. The polyethylene oxide condensates of alkyl phenols, e.g., the condensation products of alkyl phenols having an alkyl group containing from about 6 to about 20 carbon atoms in either a straight chain or branched chain configuration, with ethylene oxide, said ethylene oxide being present in amounts equal to from about 6 to about 60 moles of ethylene oxide per mole of alkyl phenol. The alkyl substituent in such compounds may be derived from polymerized propylene, diisobutylene, octane, or nonane.

b. Surfactants derived from the condensation of ethylene oxide with the product resulting from the reaction of propylene oxide and ethylene diamine which may be varied in composition depending upon the balance between the hydrophobic and hydrophilic moieties present. For example, compounds containing from about 40% to about 80% polyoxyethylene by weight and having a molecular weight of from about 5,000 to about 11,000 resulting from the reaction of ethylene oxide groups with a hydrophobic base which is the reaction product of ethylene diamine and excess propylene oxide, said base having a molecular weight of the order of about 2,500 to about 3,000, are satisfactory.

c. The condensation product of aliphatic alcohols having from about 6 to about 26 carbon atoms, more preferably about 8 to about 18 carbon atoms, in either straight chain or branched chain configuration, with ethylene oxide, e.g., fatty alcohol ethylene oxide condensates having from about 6 to about 30 moles of ethylene oxide per mole of alcohol, the alcohol fraction having from about 8 to about 26 carbon atoms.

d. Long chain tertiary amine oxides corresponding to the following general formula:

$$R_1R_2R_3N\rightarrow 0$$

wherein $R_1$ contains alkyl, alkenyl or monohydroxyalkyl radical ranging from about 8 to about 18 carbon atoms in chain length, from 0 to about 10 ethylene oxide moieties and from 0 to about 1 glyceryl moiety and R' and R" are each alkyl or monohydroxyalkyl groups containing from about 1 to about 3 carbon atoms. The arrow in the formula is a conventional representation of a semipolar bond. Examples of suitable phosphine oxides are: dodecyldimethylphosphine oxide, tetradecyldimethylphosphine oxide, tetradecylmethylethylphosphine oxide, 3,6,9-trioxaoctadecyldimethylphosphine oxide, cetyldimethylphosphine oxide, 3-dodecoxy-2-hydroxypropyldi(2-hydroxyethyl) phosphine oxide, stearyldimethylphosphine oxide, cetylethylpropylphosphine oxide, oleyldiethylphosphineoxide, dodecyldiethylphosphine oxide, tetradecyldiethyl-phosphine oxide, dodecyldipropylphosphineoxide, dodecyldi(hydroxymethyl)phosphine oxide, dodecyldi(2-hydroxyethyl)phosphine oxide, tetradecylmethyl-2-hydroxypropylphosphine oxide, oleydimethylphosphine oxide, 2-hydroxydodecyldimethylphosphine oxide and the like.

f. Long chain dialkyl sulfoxides containing one short chain alkyl or hydroxy alkyl radical of from about 1 to about 3 carbon atoms (usually methyl) and one long hydrophobic chain which include alkyl, alkyenyl, hydroxy alkyl, or keto alkyl radicals containing from about 8 to about 20 carbon atoms, from 0 to about 10 ethylene oxide moieties and from 0 to about 1 glyceryl moiety. Examples include: octadecyl methyl sulfoxide, 2-ketotridecyl methyl sulfoxide, 3,6,9-trixaoctadecyl 2-hydroxyethyl sulfoxide, dodecyl methyl sulfoxide, oleyl 3-hydroxypropyl sulfoxide, tetradecyl methyl sulfoxide, 3-methoxytridecyl methyl sulfoxide, 3-hydroxytridecyl methyl sulfoxide, 3-hydroxy-4-dodecoxybutyl methyl sulfoxide and the like.

The most preferred non-ionic surfactants are those of category (c) above and especially include condensates of $C_9$ to $C_{11}$ mixed alcohols with 6–10 moles of ethylene oxide and condensates of $C_{12}$ to $C_{15}$ or $C_{14}$ to $C_{15}$ mixed alcohols with 10–12 moles of ethylene oxide, since these tend to promote the development of emulsions having a large $L_c$ dilution range. The most preferred non ionic surfactants are those having an HLB value in the range of from about 12 to about 15.

Where the emulsion composition is intended as a carrier for cationic softening agents, it is preferred that the surfactant be non-ionic in character in order to avoid ionic interactions which complicate the viscosity enhancing characteristics and physical stability of the emulsion concentrate when diluted with water. For other applications where softeners which are not cationic are included in the composition, a portion of the non-ionic surfactant can be replaced with detersive surfactants which may be anionic or amphoteric in nature.

Suitable anionic surfactants include alkyl sulfates, alkyl ether sulfates, alkaryl sulfonates, alkyl succinates, alkyl sulfosuccinates, N-alkyl sarcosinates and alpha-olefin sulfonates, particularly the sodium, magnesium, ammonium and mono, -di-and triethanolamine salts.

Specific examples of anionic surfactants include sodium lauryl sulfate, sodium oleyl succinate, sodium dodecylbenzene sulfonate and N-lauryl sarcosinate, as well as ether condensates thereof such as sodium lauryl ether sulfate (2–3 EO), and ammonium lauryl ether sulfate (1–3EO).

Amphoteric surfactants which may be used include alkyl amine oxides, alkyl betaines, alkyl amido betaines, alkyl sulfobetaines, alkyl glycinates and alkyl carboxyglycinates, wherein the alkyl groups contain 8 to 18 carbon atoms. Examples include lauryl amine oxide, cocamidopropyl betaine, cocodimethyl sulfopropyl betaine and cocobetaine.

A more detailed illustration of the various surfactants and classes of surfactants mentioned may be found in the text *Surface Active Agents,* Vol. II, by Schwartz, Perry and Berch (Interscience Publishers, 1958), in a series of annual publications entitled *McCutcheon's Detergents and Emulsifiers,* issued in 1969, or in *Tenside-Taschenbuch,* H. Stache, 2nd Ed. Carl Hanser Verlag, Munich and Vienna, 1981.

The amount of surfactant present in the concentrate may generally be up to about 70% by weight in concentrates having high levels of active ingredients and little or no added water. Preferred concentrates in the form of water-in-oil emulsions and containing fabric softener will generally contain from about 1 to about 65%, preferably from about 1.5 to 35% by weight of surfactant.

The weight ratio of surfactant to oil present in the concentrate may generally range from about 1:0.4 to 1:2.2.

The concentrates of the present invention may be fabric softener concentrates which also contain from about 1 to about 25% by weight of a non-ionic for cationic fabric softener component. Suitable known non-ionic softeners include swelling bentonite clay and fatty ($C_{12}$–$C_{20}$) acid partial esters of polyhydric alcohols having 3 to 8 carbon atoms, including esters of glycerol, diglycerol, xylitol, sucrose, erythritol, pentaerythritol, sorbitol or sorbitan. Preferred partial esters include sorbitan monostearate, sorbitan dilaurate and pentaerythritol distearate.

Other non-ionic softeners which may be used include imidazoline compounds, or amidoamines having the structure 1:

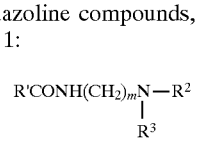

1.

wherein R' is a $C_{12}$ to $C_{30}$ alkyl or alkenyl group, $R^2$ is $R^1$, $R^1CONH(CH_2)_m$ or $CH_2CH_2OH$, $R^3$ is hydrogen, methyl or $(CH_2CH_2O)_pH$, m is a number of 1 to 5 and p is a number of 1 to 5.

Suitable cationic softeners useful in the present invention also include quaternary ammonium salts containing at least one and preferably two long chain alkyl groups of 8 to 30 carbon atoms, preferably 8 to 22 carbon atoms and optionally at least one lower alkyl group or substituted lower alkyl group, for example, methyl, ethyl or a 2-hydroxyethyl group. Preferred salts are dimethyl distearyl ammonium chloride and dimethyl ditallow ammonium chloride. Also included are cationic imidazolinium salts.

Also included are cationic salts having the structure of formula 2 above, used alone or in a 5:1 to 1:5 weight ratio combination with biodegradable fatty ester quaternary ammonium compounds having the formula 2:

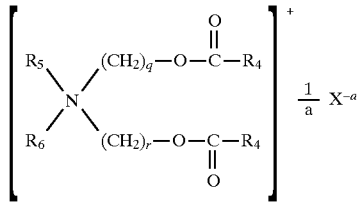

2.

wherein each $R_4$ independently represents an aliphatic hydrocarbon group having from 8 to 22 carbon atoms; $R_5$ represents $(CH_2)s\ R^7$ (where $R^7$ represents an alkoxy carbonyl group containing from 8 to 22 carbon atoms, benzyl, phenyl, ($C_1$–$C_4$)-alkyl substituted phenyl, OH or H); $R_6$ represents $(CH_2)_t\ R^8$ (where $R^8$ represents benzyl, phenyl ($C_1$–$C_4$)-alkyl substituted phenyl, OH or H); q, r, s and t each independently represent a number of from 1 to 3; and x is an anion of valence a. Preferred such combinations include a mixture of the chloride, sulfate or methylsulfate salts of bis(tallowamidoethyl)-2-hydroxyethylamine and/or bis (hydrogenated tallowamidoethyl) -2-hydroxyethylamine and N-methyl-N,N,N-triethanolamine ditallowester quaternary ammonium methosulfate.

The more preferred cationic softeners for use in the present invention are of the types disclosed in U.S. Pat. Nos. 4,476,030 and 5,133,885, the complete disclosures of which are incorporated herein by reference.

Concentrates of the invention which contain a cationic softening agent, e.g., an ester quat, also desirably contain a minor amount of an electrolyte salt which tends to reduce the particle size of the dispersed softening agent, thereby further controlling viscosity. Suitable salts include one or a mixture of inorganic or organic salts including alkali or alkaline earth metal chloride, sulfates, phosphates, acetates or nitrates such as sodium, magnesium, lithium or calcium chloride, potassium bromide, calcium or magnesium sulfate and the like. Organic salts include the citrates, formates and salts of ethylene diamine tetraacetic acid. A preferred electrolyte is calcium chloride. Generally, the amounts of electrolyte salt may range from about 0.01 to about 2% by weight of the concentrate.

Concentrates of the invention may be in the form of solutions or dispersions containing no added water, but are preferably in the form of "$L_2$" emulsions containing at least about 2% by weight water and more preferably containing at least about 10 to 85% by weight water. Small amounts of a co-solvent may be present for adjustment of viscosity. Typical co-solvents include lower mono-and polyhydroxy alcohols present at a level of up to about 8% by weight of the concentrate. Preferred alcohols are those having 2 to 10 carbon atoms, more preferably 2 to 4 carbon atoms such as ethanol, propanol and isopropanol present in the concentrate at levels of up to about 5% by weight, e.g., from about 0.1 to 5% by weight.

The concentrates of the invention may be used in numerous applications such as fabric softeners, laundry detergents, dish detergents, shampoos, body douche and body lotions. Accordingly, they may also contain the usual quantities of one or more adjuvants such as fabric softeners, phosphorous and non-phosphorous containing builders, fluorescent brighteners, dyes, perfumes, viscosity regulators, shampoo adjuvants, enzymes, bleaches, batericidies, fungicides, antifoam agents, preservatives, stabilizers and skin conditioners. The adjuvants should not, however, be of a type which will promote instability of the product on standing.

Preferred concentrates of the invention are water emulsions containing non-ionic or cationic fabric softening agents adapted to be diluted by the consumer prior to use, and added during the rinse cycle of the machine washing process. The most preferred concentrates of the present invention exhibit $L_2$ phase viscosities in the range of from about 10 to 1500 cps, more preferably from about 100 to 1,000 cps. Upon dilution of these concentrates with sufficient water to convert the emulsion into the viscoelastic $L_c$ liquid crystal phase, viscosities of from about 50 to 1000 cps can be achieved. By proper selection of oil, surfactant, electrolyte and fabric softener additives, viscosities in the diluted concentrate equal to or higher than the viscosity of the undiluted concentrate can be achieved e.g., viscosities of from about 300 to 800 cps, more preferably 400 to 800 cps.

Concentrates of the present invention may be prepared by heating all ingredients to a liquifying temperature, generally from about 60° to 70° C. and mixing the ingredients under shear mixing conditions until a uniform dispersion or solution is formed. Mixing is continued until ambient cooling is achieved. A preferred mixing procedure for fabric softener concentrates containing added water is to first combine water, surfactant and oil and heat to about 55°–65° C., followed by addition of a heated melt of the fabric softener under shear mixing conditions until a uniform dispersion or emulsion is obtained. Electrolyte salt solution, perfume, dye or other optional additives are then preferably subsequently added to the solution under mixing conditions after cooling.

The following examples are illustrative of the invention.

All viscosity measurements referred to herein are performed using a TA Instruments CSL 100 rheometer using either a 2 cm or 4cm conical plate having a gap between 0.8–1 mm. All viscosities were measured at room temperature, 23°±2° C., at a shear rate of 15 $s^{-1}$.

EXAMPLE 1

A dispersion comprising 60% by weight of a $C_6$5EO alcohol surfactant (condensation product of hexanol with 5 moles of ethyleneoxide) and 40% by weight of dodecanol was prepared by heating the mixture at about 65° C. until a uniform solution was obtained. The solution was then cooled to room temperature. The viscosity of the solution at 15 $s^{-1}$ was about 20 cps (mPas).

This solution was then diluted with varying quantities of water to form an emulsion. The approximate viscosities and the varying levels of water dilution are shown in Table 1.

TABLE 1

| % Dilution | 0 | 12 | 25 | 35 | 50 | 62 | 75 | 80 |
|---|---|---|---|---|---|---|---|---|
| Viscosity (cps) | 20 | 25 | 30 | 500 | 1000 | 10,000 | 500 | 10 |

As is evident from Table 1, viscosity of the diluted solution shows a marked increase in the dilution range of from about 35 to 75% by weight water. This represents the viscoelastic $L_c$ phase of the emulsion. At about 80% dilution (4 volumes of water per volume of solution), the viscosity once again drops as the emulsion enters the $L_1$ or oil in water phase.

EXAMPLE 2

A fabric softener masterbatch composition was prepared by melt mixing 64% by weight of $C_{9\text{-}11}$ fatty alcohol mixture -8 EO surfactant (Neodol ™91-8), 34% by weight dodecanol and 2% water. Upon cooling, this masterbatch had a viscosity of 40 cps. Two separate portions of this masterbatch were melt mixed with 5 and 10% by weight respectively of pentaerythritol distearate (PDT) fabric softener agent.

Viscosity measurements of water-diluted concentrates were as shown in Table 2.

TABLE 2

| % Dilution Viscosity | 0 | 12 | 25 | 38 | 50 | 62 | 75 | 80 | 85 |
|---|---|---|---|---|---|---|---|---|---|
| 10% PDT | 200 | 300 | 5,000 | 10,000 | 19,000 | 20,000 | 4,000 | 600 | 200 |
| 5% PDT | 70 | 170 | 2,500 | 8,009 | 17,000 | 20,000 | 3,000 | 250 | 200 |
| Masterbatch | 40 | 80 | — | 6,000 | 9,000 | 10,000 | 4,000 | 400 | 200 |

As is evident from the viscosity data in Table 2, the presence of the PDT softening agent tends to produce higher viscosities in the masterbatch but the viscosity variations are minor at dilution levels of about 75% water. These viscosities approximate or are somewhat higher than the starting undiluted viscosities of the concentrate.

EXAMPLE 3

A fabric softener having the following composition was prepared.

| | % By Weight |
|---|---|
| Dodecanol | 6 |
| $C_{9—11}$8 EO Fatty Alcohol | 2 |
| Esterquat* | 11.2 |
| Isopropyl Alcohol | 1.3 |
| Propylene Glycol | 0.6 |
| Ca $Cl_2$ (electrolyte) | 0.7 |
| Perfume | 1.1 |
| Dye | 0.01 |

*The esterquat used is a mixture of amido amine (bis hydrogenated tallow amidoethyl-2-polyethoxyamine) and esterquat (di-tallow triethanolamine diester methyl chloride) in a 1.67/1 ratio.

This composition exhibited a viscosity of 1,000 cps in concentrate form and 100 cps after dilution with 3 volumes of water per volume per concentrate.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A laundry concentrate composition in the form of a water-in-oil emulsion containing at least about 2% by weight water and comprising a mixture of at least one non-ionic surfactant and at least one water insoluble oil containing a polar proton sharing group and having a melting point below about 30° C., said non-ionic surfactant being the condensation product of an aliphatic alcohol having from about 6 to 26 carbon atoms with ethylene oxide, said oil being selected from the group consisting of saturated aliphatic alcohols or acids containing from about 6 to 12 carbon atoms and unsaturated liquid fatty $C_{16}$ to $C_{18}$ acids or alcohols, said concentrate characterized by a viscosity of at least about 10 cps and further characterized that, upon dilution with at least about one volume of water per volume of concentrate, the concentrate is at least partially converted into a liquid crystal phase dispersion providing a diluted concentrate having a viscosity of at least about 50 cps.

2. The composition of claim 1 wherein said surfactant comprises a non-ionic surfactant selected from the group consisting of $C_9$ to $C_{11}$ mixed alcohols condensed with 6–10 moles of ethylene oxide and $C_{12}$ to $C_{15}$ mixed alcohols condensed with 10–12 moles of ethylene oxide.

3. The composition of claim 1 wherein said polar group is a hydroxy, carboxylic, amine or amido group.

4. The composition of claim 1 wherein said oil comprises an alcohol having from about 6 to 12 carbon atoms.

5. The composition of claim 4 wherein said alcohol is dodecanol.

6. The composition of claim 1 wherein the ratio of surfactant to oil present in the concentrate ranges from about 1:0.4 to 1:2.2.

7. The composition of claim 1 wherein said concentrate is in the form of a water-in-oil emulsion comprising at least 10% by weight water, from about 1 to about 60% by weight of said fatty alcohol and from about 1 to about 70% by weight of said surfactant.

8. The composition of claim 7 wherein said concentrate has a viscosity of about 10 to 1500 cps and wherein said diluted concentrate has a viscosity of from about 50 to 1000 cps.

9. The composition of claim 8 wherein said concentrate has a viscosity of about 100 to 1000 cps.

10. The composition of claim 9 wherein said diluted concentrate has a viscosity of about 300 to 800 cps.

11. The composition of claim 1 wherein said diluted concentrate has a viscosity equal to or higher than the viscosity of said concentrate.

12. The composition of claim 1 wherein said oil is present in said concentrate at a level of from about 3 to 25% by weight.

* * * * *